US006430789B1

(12) United States Patent
Esche et al.

(10) Patent No.: US 6,430,789 B1
(45) Date of Patent: Aug. 13, 2002

(54) APPLICATION OF ANTIMICROBIAL TO WARP YARN

(75) Inventors: Susan Park Esche, Liberty; Erin G. Bennett, Greensboro; Michael S Shoe, Burlington, all of NC (US)

(73) Assignee: Burlington Industries, Inc., Greensboro, NC (US)

( * ) Notice: Subject to any disclaimer, the term of this patent is extended or adjusted under 35 U.S.C. 154(b) by 0 days.

(21) Appl. No.: 09/816,670

(22) Filed: Mar. 26, 2001

(51) Int. Cl.[7] ..... D02H 5/02; B65H 71/00

(52) U.S. Cl. ..... 28/166; 28/178; 28/179; 139/426 R

(58) Field of Search ..... 28/178, 179, 182, 28/183, 180, 181, 166, 169, 151, 152, 167; 139/36, 420 R, 426 R, 383 R; 8/115.51, 115.6, 115.7, 116.1, 151.2; 442/197, 208, 209, 218; 424/402, 404

(56) References Cited

U.S. PATENT DOCUMENTS

| | | | | | |
|---|---|---|---|---|---|
| 2,698,263 | A | * | 12/1954 | Weick | 427/336 |
| 2,799,914 | A | * | 7/1957 | Nickerson | 139/420 B |
| 3,018,196 | A | * | 1/1962 | Wagner | 106/18.31 |
| 3,142,109 | A | * | 7/1964 | Stoll et al. | 139/426 R |
| 3,275,041 | A | * | 9/1966 | Williams | 139/426 R |
| 3,893,806 | A | | 7/1975 | Finch et al. | |
| 3,899,810 | A | * | 8/1975 | Stanley et al. | 139/426 R |
| 4,015,317 | A | * | 4/1977 | Johnsen | 139/435.1 |
| 4,470,252 | A | * | 9/1984 | Brodmann | 28/178 |
| 5,015,419 | A | * | 5/1991 | Moreau et al. | 514/547 |
| 5,091,247 | A | * | 2/1992 | Willibey et al. | 139/426 R |
| 5,271,998 | A | | 12/1993 | Duckett | |

FOREIGN PATENT DOCUMENTS

| | | |
|---|---|---|
| EP | 0 949 368 | 10/1999 |

OTHER PUBLICATIONS

Abstract: JP 11099589; "Antimicrobial foil sheet textile fabric –has resin layer of predefined composition formed on thin metal foil layer".

* cited by examiner

*Primary Examiner*—Amy B. Vanatta
(74) *Attorney, Agent, or Firm*—Nixon & Vanderhye P.C.

(57) ABSTRACT

A process for imparting antimicrobial properties to textile fabrics by applying an antimicrobial substance to the fibers from which the textile is woven, knit or constructed. Preferably the antimicrobial substance is applied, prior to weaving, to warp yarns on a slasher or warper or similar coating or finish application device before the warp ends are rolled up onto a loom or section beam. The warp yarns are then woven with fill yarns, not treated with the antimicrobial, into a cloth which is then sold in the loom state or subjected to subsequent finishing. A preferred cloth end use is mattress ticking.

31 Claims, 3 Drawing Sheets

APPLICATION OF ANTIMICROBIAL TO WARP YARN

BACKGROUND OF THE INVENTION

There is a need to impart antimicrobial activity to mattresses, covered box springs and similar bedding articles that are subject to the potential for mold growth or mildew and/or in contact with and contamination by various substances. Bedding products used under high humidity conditions such as prevalent in various Pacific rim countries have been constructed of fabrics treated to resist mold growth. This is particularly advantageous for fabric-covered bedding products not readily laundered or otherwise cleaned. This invention provides an improved process for imparting antimicrobial properties to textile coverings for such bedding products and other uses.

DISCLOSURE OF THE INVENTION

This invention relates to a process for imparting antimicrobial properties to textile fabrics by applying an antimicrobial substance to the fibers from which the textile is woven, knit or constructed. Preferably the antimicrobial substance is applied, prior to weaving, to warp yarns on a slasher or warper or similar coating or finish application device before the warp ends are rolled up onto a loom or section beam. The warp yarns are then woven with fill yarns, not treated with the antimicrobial, into a cloth which is then sold in the loom state or subjected to subsequent finishing. A preferred cloth end use is mattress ticking.

We have found that treating the warp yarns only and not the fill yarns and thereafter weaving the treated yarns together with untreated weft or fill yams into a cloth is sufficient to impart the desired antimicrobial properties of inhibiting the growth of bacteria and fungi in and to the woven product. This process of antimicrobially treating warp yams only is more efficient and less costly than treating or finishing woven fabric in a pad bath in open width. The antimicrobial substance is applied in an economical manner with minimal mixing and processing and results in only small quantities of unused or otherwise unsuited materials. Such bioactive materials when expended and discharged often require controlled environmental handling and waste disposal processing.

The fibers of the yarns to be treated by this process may be in filament or spun yam form, textured such as false twisted or not. The fibers may be cellulosic-based fibers such as cotton, rayon or linen, or synthetic fibers such as nylons, polyesters, polyolefins such as polypropylene and the like as well as natural protein fibers such as wool or silk, or may be blended yarns containing two or more types of fibers, particularly cotton/polyester or cotton/nylon blends. Preferably the fibers used to form the warp are robust such as polyester or spun rayon yarn while the fill may be a less robust fiber such as cotton, rayon or polypropylene. The warp yams subjected to antimicrobial treatment according to this process may be slashed/sized, slasher dyed or unsized yams prior or subsequent to antimicrobial application.

The antimicrobial applied to the warp yams preferably has both bacterostatic and fungistatic properties and thus imparts to the finished fabric resistance to bacterial growth and fungal growth sufficient to inhibit the growth of mildew and associated deterioration and discoloration as well as inhibiting microbial odor development. Suitable antimicrobial compositions are available to the textile industry from various suppliers and are approved for use on textiles by the Environmental Protection Agency. These include 5-chloro-2(2,4-dichlorophenoxy)phenol also known as triclosan manufactured by Sanitize AG and marketed by Clariant Corporation of Charlotte, NC as Sanitized® T96-21. Sanitized® XTX, manufactured by Sanitized AG and marketed by Sanitize, Inc. is also effective when applied in this manner. Both products are an anionic antimicrobial agent effective against gram positive and gram negative bacteria, fungi and yeast. The agent is biostatic against mold, mildew and the like and acts to prevent offensive odors resulting from bacterial decomposition of absorbed perspiration. Another commercially available product is Bioshield available as an aqueous solution of octdecylaminodimethyltrimethoxysilylpropyl ammonium chloride, methanol, and chloropropyltrimethoxysilane. This product is manufactured by Bioshield Technologies Inc of Norcross, Georgia and distributed by a number of firms including Apollo Chemical of Burlington, NC. The Bioshield product is a cationic organosilane compound which is claimed to be effective on gram positive and negative bacteria, fungi and algae. It is EPA approved for mattress pads and ticking.

The choice of antimicrobial agent depend to the type or types of odor-causing or textile fabric discoloring/degrading microbes encountered where the textile product is used. Agents active against dust mites may also be considered.

The antimicrobial substance is applied to the yarn by any suitable means such as by a slasher of the type typically used for applying size. Preferred is an over-oiler of the type used to apply weaving aid lubricants to warp yarns. The antimicrobial substance is conveniently in the form of liquid, preferably in an aqueous solution or dispersion. Also present in the solution, suspension or dispersion may be ancillary components used by the product manufacturer to control pH, stability, solubility, viscosity, product concentration, and wetting characteristics. These products will differ upon the type of antibacterial agent used in the application and the concentration of the active ingredient in the product used. Additional components may be combined with the antimicrobial products as purchased to modify or add to properties such as concentration of active ingredient, ability to kill other microorganisms such as dust mites, modification of the warp to improve processing characteristics such as weaving efficiency, and modification of the warp to improve aesthetic properties of the finished fabric.

The amount of antimicrobial to be applied can be adjusted as required by changing the pulley which ties the speed of the over-oiler application wheel to the speed at which the yarn runs through the slasher. Finishing processes include various backcoatings to impart resistance to fraying, flame retardency, and improved sewing characteristics and various heat and pressure treatments to improve the finished appearance of the face of the fabric.

In a preferred aspect of the invention the antimicrobial product is applied "neat" (not diluted) in concentrated formulations available from the supplier to one side of a yarn sheet which is subsequently rolled up- transferring application to the other side of the sheet. This method is very efficient with respect to antimicrobial product usage and the thus coated yams require no subsequent drying thereby eliminating additional processing steps. Other, more widely used methods such as those typically recommended by the suppliers of antimicrobial finishes require that the material be diluted, padded onto already woven fabric and subsequently dried or that they be applied from an aqueous dyebath in an exhaust dyeing process. Both of these methods require a drying step and involve more waste of material. The waste in the procedures of our invention is virtually nil as the antimicrobial composition is applied only to the warp yarns in an efficient application device such as an over-oiler.

BRIEF DESCRIPTION OF THE DRAWINGS

The invention is now described with reference to the attached drawings which serve to further illustrate and explain the invention in which.

DESCRIPTION OF THE INVENTION

Figure 1:
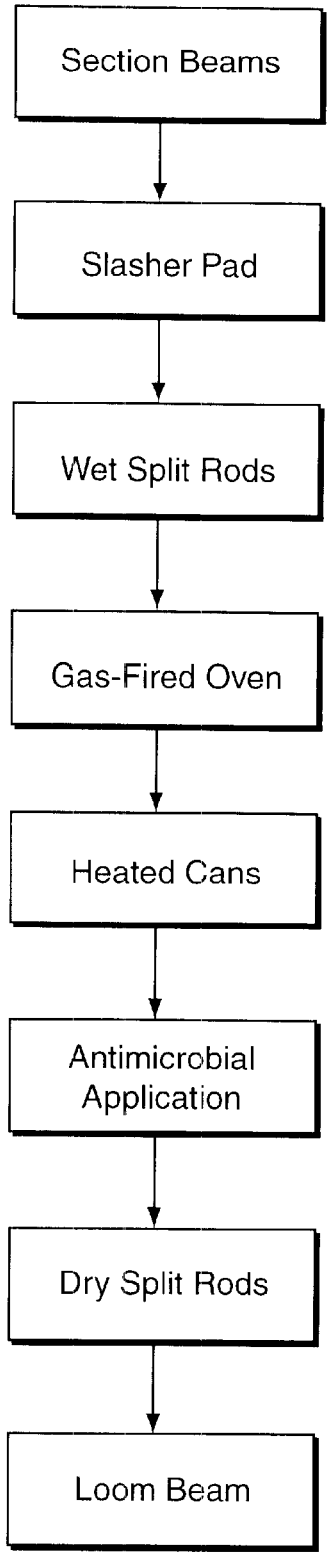
FIG. 1 is a diagram showing antimicrobial application on an over-oiler slasher.

The process of the invention is conveniently carried out using existing/conventional sizing equipment or special purpose built single end processing equipment may be used. Three different arrangements are shown in the drawings. In the arrangement shown in FIG. 1 yarns from section beams are directed to a slasher pad where size is applied, the yarns are then separated or wet split over lease rods or similar metal rods and dried first in a gas-fired oven then, optionally, by passing over heated drying cans. The antimicrobial composition is then applied using an over-oiler (of the type commonly used to apply lubricant to the warp), the yarns are separated and dried and wound on a loom beam prior to weaving.

Figure 2:
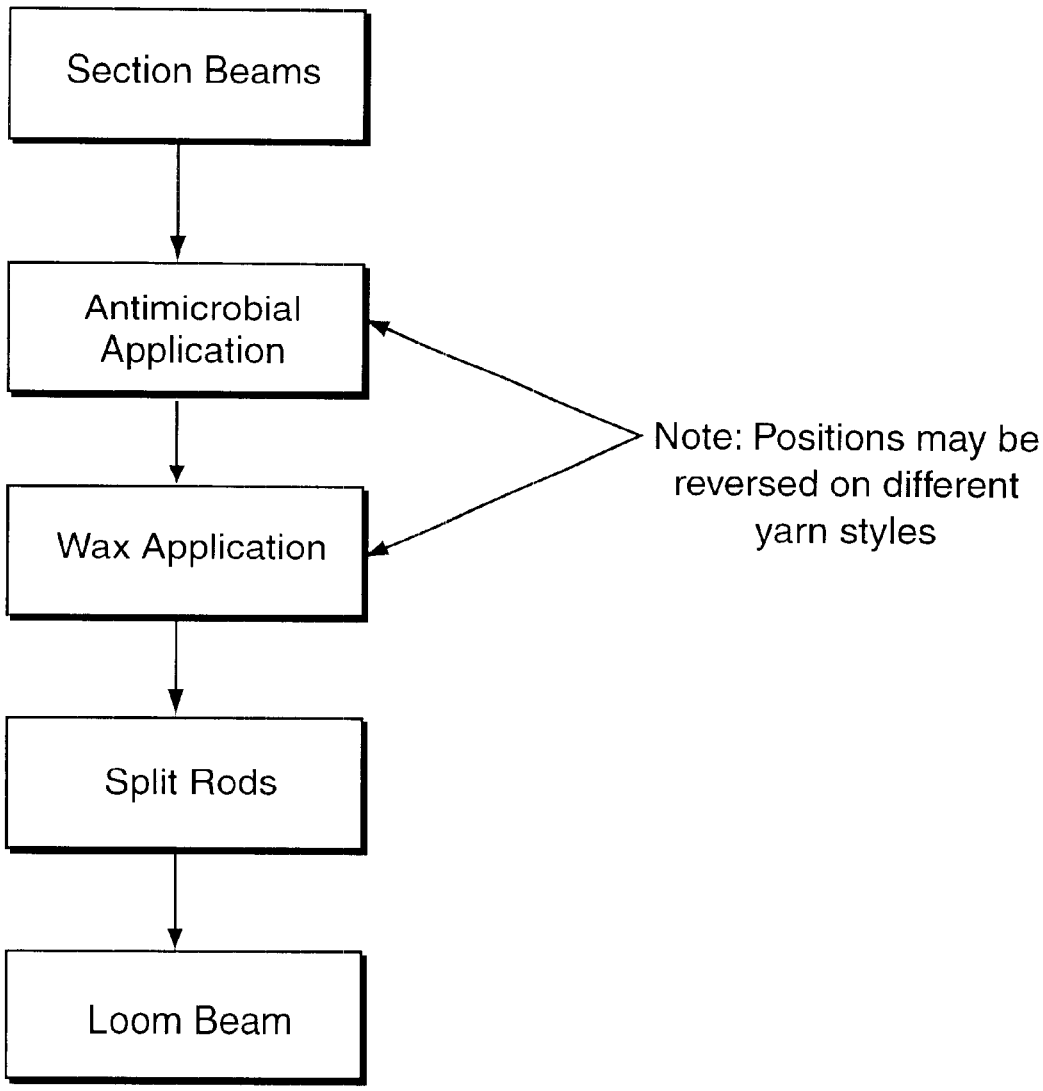
FIG. 2 is a diagram showing antimicrobial application on a re-beamer.

In the arrangement shown in FIG. 2 yarns from the section beams are subjected first to antimicrobial application and then to wax application, both in an over-oiler or, alternatively, depending on yarn style, wax application is first followed by antimicrobial composition application. Next the yarns are split and taken up on the loom beam. No size is applied during this process and heating is not usually required.

Figure 3:
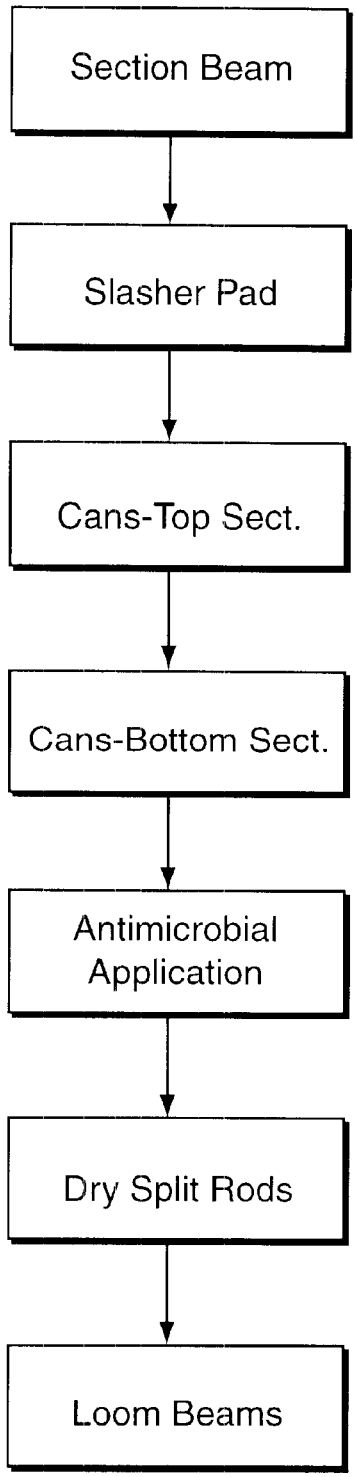
FIG. 3 is a diagram showing antimicrobial application on a can slasher.

In the arrangement of FIG. 3 yarns from the section beam are padded with a size then passed over a series of two sets of steam heated drying cans for drying, then an antimicrobial composition is applied in a slasher, the yarns are split into groups for drying and then taken up on a loom beam. This arrangement is similar to that of FIG. 1 and uses steam heated cans instead of an oven for drying. In each of these embodiments the treated warp yarns are woven with untreated fill yarns into a fabric which may be marketed directly or subjected to further finishing procedures as may be required.

BEST MODE FOR CARRYING OUT THE INVENTION

EXAMPLE 1

A warp consisting of polyester filament yarn was slasher dyed with polyester size including Seycofilm EPF-600, EPF-60OBL, Texfilm 246NB, and Eastman WD, pigments, and a melamine binder. The coating was dried and cured by heating in a gas fired oven at 375 to 385° F. degrees for 10 to 30 seconds, achieving DTMA values of 212 to 260° F. After drying and curing, the yarn sheet was passed over steam cans. An application of Sanitize XTX was applied after the steam cans by passing the yarn sheet over an over-oiler containing the Sanitize material. Applications rates range from 0.3 to 1.0% owf. The yarn sheet was then separated by passing over metal rods and brought back together onto a loom beam. This warp was woven with untreated fill yarns of cotton, rayon and polypropylene. In both the greige and finished states it was found to inhibit the growth of bacteria when tested by methods ATCC 6538 and ATCC 4352.

EXAMPLE 2

Example 1 was repeated except the antimicrobial used was Sanitize T-9621. This also was woven with untreated fill yarns, finished and was found to inhibit the growth of bacteria when tested by methods ATCC6538 and ATCC4352.

EXAMPLE 3

Example 1 was repeated except that the warp yarn was a 150 denier T-660 Wellman textured polyester yarn. Application levels were 0.5% and 1.0% owf of the Sanitize T-9621. The warp was woven, finished and tested with similar results to those from Example 1.

EXAMPLE 4

Example 1 was repeated except that the warp yarn was a textured150 denier T-693 DuPont yarn. Application level was 0.5% owf of Sanitize T-9621. The yarn was woven, finished and tested with similar results to Example 1.

EXAMPLE 5

Example 1 was repeated except the antimicrobial used was Bioshield AM 500 I. The yam was woven, finished and tested according to AATCC test method 100-1993 and found to reduce bacterial growth by 97.7%.

EXAMPLE 6

In another example, a trial was run in which a warp consisting of a 2-ply spun rayon yarn was assembled on a re-beamer. This re-beamer combines yarns from multiple section beams onto a loom beam. For this trial, the yarn from the section beams was brought together into a single sheet and passed over an over-oiler containing Sanitize T-9521. This antimicrobial was applied at levels of 0.5%, 1.0% and 1.5% owf. After application of the antimicrobial, the warp yarns were treated with melted wax, also by an over-oiler at approximately 0.5% owf, as a weaving aid. It is expected that the order of application of these two products could be reversed. These loom beams were woven with untreated fill yam of polypropylene and found to inhibit the growth of bacteria when tested by ATCC 6538 and ATCC 4352.

EXAMPLE 6

Example 2 was repeated except that the sizing agent used was Absize PPS-10, a formaldehyde-free sizing product available from ABCO Industries of Roebuck, South Carolina and the melamine resin was eliminated.

EXAMPLE 7

Example 2 was repeated except that the binder used was Seycofilm 3276 in conjunction with Seycofilm EPF-600 BL, a formaldehyde free product available from Seydel-Wooley of Pendergrass, Georgia, and the melamine resin was eliminated.

EXAMPLE 8

Example 2 was repeated except that the sizing agent used was Seycofilm SW-2 and the melamine resin was eliminated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process of preparing a warp and fill woven textile resistant to microbial colonization comprising the steps of applying to previously sized warp yarns on a slasher an antimicrobial composition and thereafter weaving fill yarns themselves devoid of antimicrobial properties between the thus-treated warp yarns to produce a woven textile fabric resistant to microbial colonization and growth thereon.

2. The process of claim 1 wherein the antimicrobial is applied to the warp yarns in an oil-over applicator mounted on a slasher, warper, or re-beamer.

3. The process of claim 1 wherein the warp yarn sare polyester or rayon.

4. The process of claim 1 wherein the fill yarn sare cotton or polypropylene.

5. The process of claim 3 or claim 4 wherein the yarn sare texturized.

6. The process of claim 1 wherein the antimicrobial is applied to the warp yarns only in an over-oiler as a solution or dispersion of an antimicrobial compound or mixture of compounds.

7. The process of claim 6 wherein the amount of antimicrobial solution or dispersion is from 0.1 to 10% wet pickup based on the weight of the yarn.

8. The process of claim 7 wherein the amount of antimicrobial solution or dispersion applied to the warp yarn is from 0.25 to 2.0% based on the weight of the yarn.

9. The process of claim 1 wherein the woven textile fabric is a mattress ticking.

10. A process of preparing a warp and fill woven textile resistant to bacterial and fungal colonization comprising the steps of applying to previously sized warp yarns on a slasher an antibacterial and antifungal composition and thereafter weaving fill yarns themselves devoid of antibacterial and antifungal properties between the thus-treated warp yarns to produce a woven textile fabric resistant to fungal colonization and growth thereon.

11. The process of claim 10 wherein the composition is applied to the warp yarns only in an over-oiler as a solution or dispersion of a compound or mixture of compounds.

12. The process of claim 11 wherein the amount of antibacterial and antifungal solution or dispersion is from 0.1 to 10% wet pickup based on the weight of the yarn.

13. The process of claim 12 wherein the amount of antibacterial and antifungal solution or dispersion applied to the warp yarn is from 0.25 to 2.0% based on the weight of the yarn.

14. A process of preparing a warp and fill woven textile resistant to yeast colonization comprising the steps of applying to previously sized warp yarns on a slasher an antiyeast composition and thereafter weaving fill yarns themselves devoid of antiyeast properties between the thus-treated warp yarns to produce a woven textile fabric resistant to yeast colonization and growth thereon.

15. The process of claim 10 or claim 14 wherein the composition is applied to the warp yarns in an oil-over slasher.

16. The process of claim 10 or 14 wherein the warp yarns are polyester or rayon.

17. The process of claim 10 or claim 14 wherein the fill yarns are cotton or polypropylene.

18. The process of claim 16 wherein the yarns are texturized.

19. The process of claim 17 wherein the yarns are texturized.

20. The process of claim 10 or claim 14 wherein the woven textile fabric is a mattress ticking.

21. A process of preparing a warp and fill woven textile resistant to microbial colonization comprising the sequential steps of:

(a) applying size to warp yarns, (b) drying and curing the applied size, and thereafter (c) applying to warp yarns on a slasher an antimicrobial composition, and thereafter (d) weaving fill yarns themselves devoid of antimicrobial properties between the thus-treated warp yarns to produce a woven textile fabric resistant to microbial colonization and growth thereon.

22. The process of claim 21 wherein the antimicrobial is applied in step (c) to the warp yarns in an oil-over applicator mounted on a slasher, warper, or re-beamer.

23. The process of claim 21 wherein the warp yarns are polyester or rayon.

24. The process of claim 21 wherein the warp yarns are polyester or spun rayon.

25. The process of claim 21 wherein the fill yarns are cotton, rayon or polypropylene.

26. The process of claim 21 wherein the yarns are spun yarns or filament yarns.

27. The process of claim 26 wherein the filament yarns are texturized.

28. The process of claim 21 wherein the antimicrobial is applied to the warp yarns only in an over-oiler as a solution or dispersion of an antimicrobial compound or mixture of compounds.

29. The process of claim 26 wherein the amount of antimicrobial solution or dispersion applied in step (c) is from 0.1 to 10% wet pickup based on the weight of the yarn.

30. The process of claim 29 wherein the amount of antimicrobial solution or dispersion applied to the warp yarn is from 0.25 to 2.0% based on the weight of the yarn.

31. The process of claim 21 wherein the woven textile fabric is a mattress ticking.

* * * * *